US005294029A

United States Patent [19]

Shimura et al.

[11] Patent Number: 5,294,029

[45] Date of Patent: Mar. 15, 1994

[54] DEVICE FOR LODGING A SUSPENDING STRAP FOR A PORTABLE OBJECT

[75] Inventors: Nobuyoshi Shimura, Saitama; Koji Kawano, Tokyo, both of Japan

[73] Assignees: Major Co., Ltd.; Super Collection Co., Ltd., both of Tokyo, Japan

[21] Appl. No.: 908,852

[22] Filed: Jul. 1, 1992

Related U.S. Application Data

[63] Continuation of Ser. No. 616,183, Nov. 20, 1990, abandoned.

[30] Foreign Application Priority Data

| | | | |
|---|---|---|---|
| Nov. 21, 1989 | [JP] | Japan | 1-302538 |
| May 18, 1990 | [JP] | Japan | 2-128855 |
| Sep. 5, 1990 | [JP] | Japan | 2-235231 |

[51] Int. Cl.[5] ..... B65H 75/40

[52] U.S. Cl. ..... 224/162; 224/258; 242/107.7; 150/108

[58] Field of Search ..... 224/162, 202, 257, 258; 242/107.6, 107.7; 150/108

[56] References Cited

U.S. PATENT DOCUMENTS

| | | | |
|---|---|---|---|
| 506,649 | 10/1893 | Watson | 242/107.6 |
| 1,465,281 | 8/1923 | Morrison | 242/107.6 |
| 2,441,902 | 5/1948 | Powell | 224/162 |
| 3,198,300 | 8/1965 | Tuttle | 224/162 |
| 4,658,999 | 4/1987 | Hilty | 224/162 |
| 5,027,874 | 7/1991 | Gazzola | 224/162 |

FOREIGN PATENT DOCUMENTS

| | | | |
|---|---|---|---|
| 1028376 | 5/1953 | France | 224/162 |
| 401381 | 4/1966 | Switzerland | 224/162 |
| 4106 | of 1908 | United Kingdom | 242/107.6 |

*Primary Examiner*—Linda J. Sholl

*Attorney, Agent, or Firm*—Oliff & Berridge

[57] ABSTRACT

A suspending strap lodging device allows a suspending strap to be extracted from or withdrawn into a portable object, such as a bag, depending upon whether or not the strap is needed. The device includes a mechanism for allowing the strap to be withdrawn or extracted to a desired length; a locking mechanism for controlling movements of the strap steplessly in both the withdrawing and the extracting directions; and a mechanism for releasing the locking mechanism. The locking mechanism provided in the withdrawing and extracting mechanism prevents the weight of the portable object, or the impact load caused when the object is lifted, from being directly exerted on the strap, thereby enabling the strap to be securely locked in position and allowing it to enjoy a long service life. Also a strap may be equipped with its own strap lodging device. Since it is equipped with a lodging device of its own, this strap can easily replace the straps of existing portable objects. Further, a mounting structure allows a strap lodging device to be mounted on a portable object. The structure, which can be applied, for example, to a video camera, adopts a single strap which serves as a shoulder strap, a grip strap and a hand grip.

4 Claims, 10 Drawing Sheets

DEVICE FOR LODGING A SUSPENDING STRAP FOR A PORTABLE OBJECT

This is a continuation of application Ser. No. 07/616,183 filed Nov. 20, 1990, now abandoned.

BACKGROUND OF THE INVENTION

1. Field of the Invention

This invention relates to a device for lodging a suspending strap for a portable object. The device enables the suspending strap of a portable object (e.g., a shoulder strap, a handle or the like), which is attached to a portable object (e.g., a bag, a camera, a box, etc.), to be extracted or withdrawn depending upon whether or not such a strap is needed.

2. Description of the Related Art

Generally speaking, a portable object of the above-mentioned category, for example, a briefcase or a sports bag, is equipped with a handle so that it may be carried by hand. In some cases, however, such a portable object may be so heavy that it tires the hand when it is carried by the handle alone for a long time, or it may prove inconvenient when the person carrying it wishes to use both hands for something else. For this reason, a suspending strap, such as a shoulder strap, has to be attached to the portable object.

A suspending strap attached to a portable object, for example, the shoulder strap of a bag, is so designed that its length can be varied by means of an adjusting member such as a buckle. In other words, the length of the suspending strap must be adjusted to fit the person using the bag, which is rather bothersome. Moreover, since it is rather long, the strap may hang loose from the portable object. This condition is undesirable because the strap may be caught by some protruding object, causing the portable object to drop when it is being carried. In some cases, that condition could even lead to an accident. In addition, the suspending strap may become dirty when the portable object is put on the ground, with the result that it stains the clothes of the person carrying the portable object. In any case, such a strap is in the way when it is not being used, which is very inconvenient.

There exists a conventionally known structure which aims to eliminate the above problems by means of a so-called hook fixture or the like which allows the suspending strap to be attached to or detached from the portable object depending upon whether or not the strap is needed. However, such a suspending strap is not attached or detached to or from the associated portable object each time it becomes necessary or unnecessary. It is usually while the portable object is being carried about that the suspending strap becomes necessary or unnecessary. In other words, the strap is not usually detached even if it becomes unnecessary. Accordingly, this known structure is not useful in eliminating the above problems and inconveniences. On the contrary, this conventional structure is inconvenient in that, when the strap is not needed, the part of the strap hanging from the portable object has to be put away in the portable object so that it will not be in the way, or it has to be gripped together with the handle. Thus, at present, only such primitive measures are available to cope with the above inconvenience.

In view of this, a variety of strap lodging devices have been proposed in which the strap can be withdrawn into the portable object (by winding it up) or extracted therefrom depending upon whether or not the strap is to be regularly used. These conventional lodging devices adopt either of the following two types of locking mechanism: (1) the strap itself is press-locked so as to prevent it from being extracted or withdrawn inadvertently; or (2) a so-called ratchet mechanism allows the winder of the strap to rotate in one direction only. The structure of the former mechanism is fatally defective in that locking cannot be securely effected since the lock position is subject to displacement due to the weight of the associated portable object and the impact load generated when the object is lifted. Accordingly, the strap of such a mechanism does not have a long service life. The problem with the latter mechanism is that locking is only effected in either the winding or the extracting direction, which means it is not suitable for the strap lodging device of a portable object.

Apart from this, these conventional lodging devices, adapted to portable objects such as bags, are all meant to be provided in the associated portable objects during manufacture, which means they are difficult to retrofit to previously manufactured portable objects. Moreover, these conventional devices will deprive the portable object of part of its effective space. Further, in some types of portable objects, for example, a video camera, little space is available for mounting to the lodging device, which means it cannot be easily adapted to such a portable object.

SUMMARY OF THE INVENTION

The present invention has been made in order to eliminate the above-mentioned problems in conventional suspending strap lodging devices so as to allow such strap lodging devices to be used more conveniently and effectively.

It is an object of this invention to provide a suspending strap lodging device which allows a suspending strap to be extracted from a portable object, e.g., a bag, or withdrawn into it depending upon whether or not the strap is needed.

Another object of this invention is to provide a suspending strap equipped with its own suspending strap lodging device.

Still another object of this invention is to provide a mounting structure for allowing a suspending strap lodging device to be mounted on a portable object which requires the associated strap.

The suspending strap lodging device in accordance with the present invention comprises: means for extracting and withdrawing the suspending strap; means for locking the extracting and withdrawing means so as to control movements of the strap in both the withdrawing and the extracting directions in a stepless manner; and means for releasing the locking means. The device may further comprise means for removably attaching the device to the portable object.

The suspending strap in accordance with the present invention comprises: a strap portion; and a lodging device attached to the strap portion and capable of withdrawing or extracting the strap portion. The strap may further comprise means for removably attaching the strap to the portable object.

BRIEF DESCRIPTION OF THE DRAWINGS

FIG. 6(*b*) is an inner bottom view of the strap lodging device of FIG. 6(*a*), showing the mechanisms for locking and releasing the strap;

FIG. 6(*c*) is a horizontal sectional view of the mechanisms of FIG. 6(*b*);

FIG. 6(*d*) is an enlarged perspective view of the joint section of the third embodiment for connecting the components of the suspending strap, i.e., the strap and the associated wire, to each other;

FIG. 15(*b*) is an overall perspective view of the same video camera of FIG. 15(*a*), showing the strap extracted from the lodging device;

FIG. 16(*b*) is an overall perspective view of a mounting plate for the strap lodging device of FIG. 16(*b*)

DETAILED DESCRIPTION OF THE PREFERRED EMBODIMENTS

Figure 1:
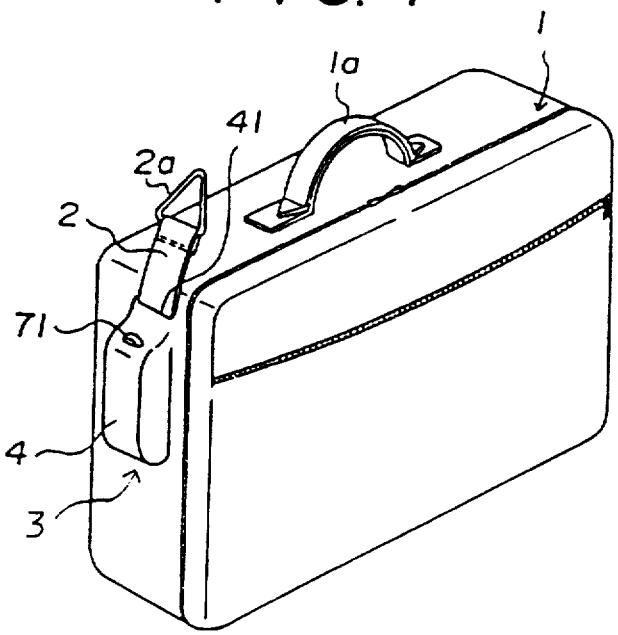
FIG. 1 is a perspective view of a portable object provided with a suspending strap lodging device in accordance with a first embodiment of this invention.
Figure 2:
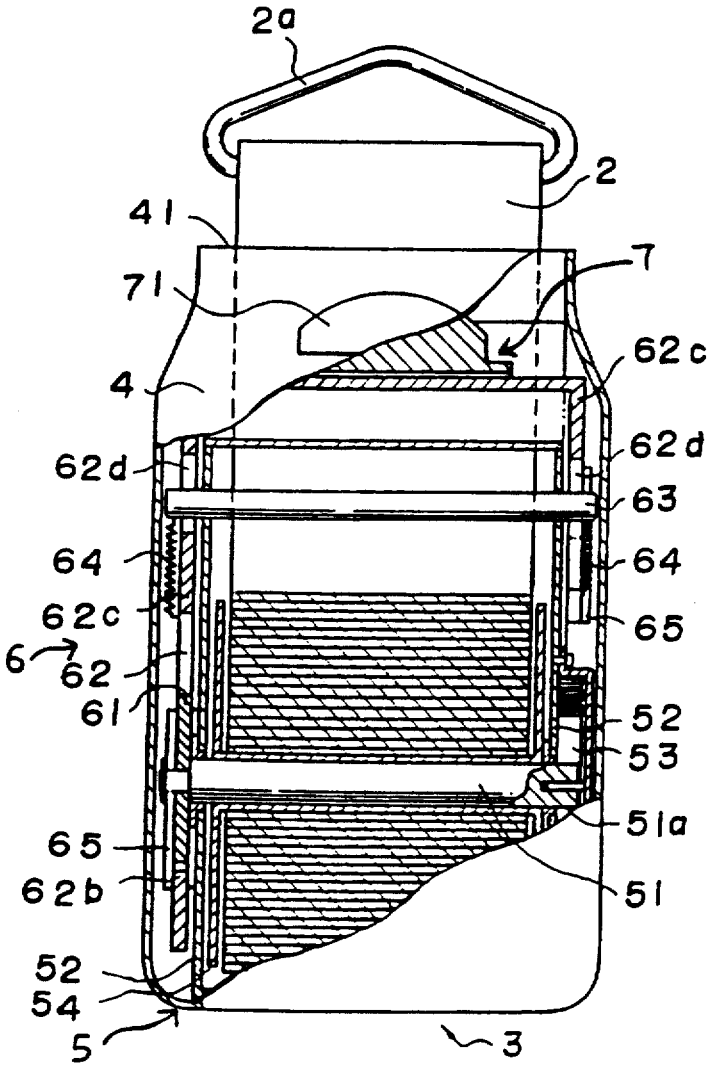
FIG. 2 is a longitudinal sectional view showing a part of the strap lodging mechanism of the first embodiment.
Figure 4:
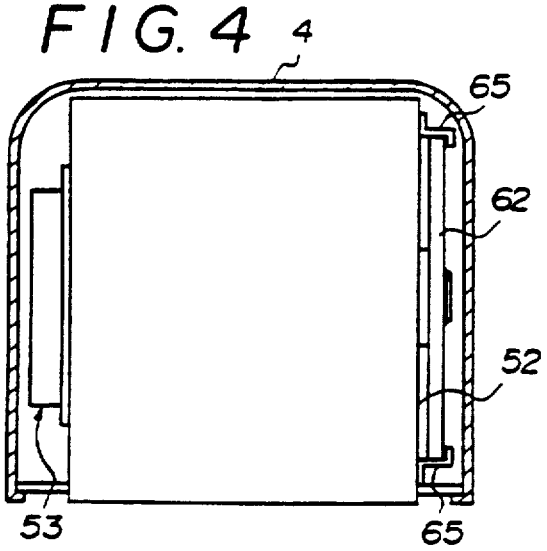
FIG. 4 is an inner bottom view of the strap lodging mechanism of FIG. 2.
Figure 3:
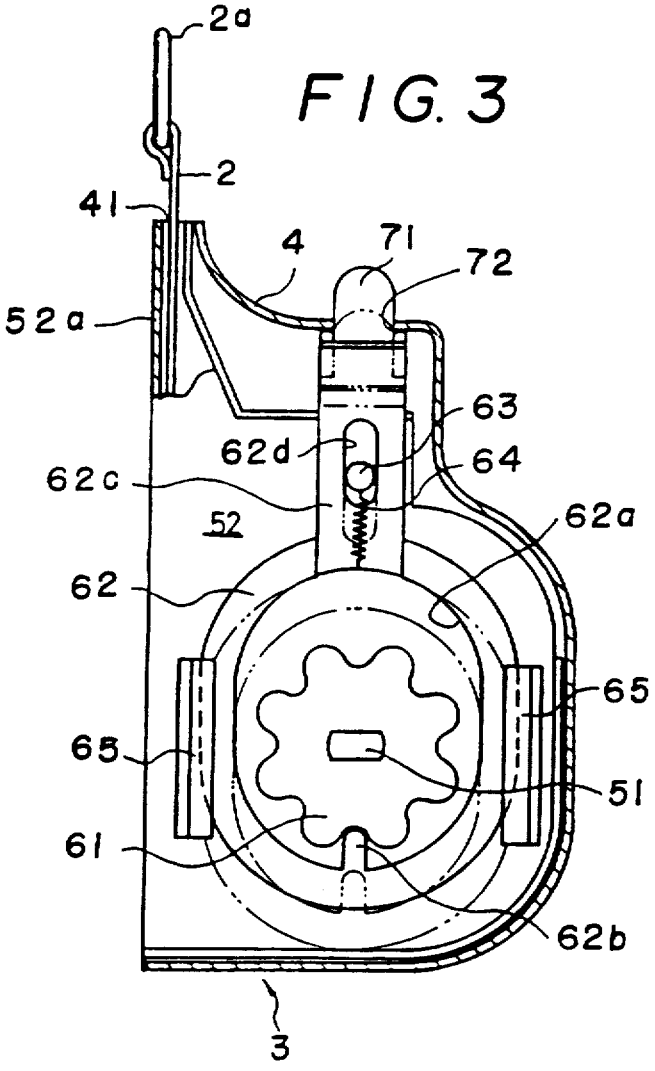
FIG. 3 is an inner side view of the strap lodging mechanism of FIG. 2, showing the mechanisms for locking and releasing the strap.

This invention will be better understood from the following detailed description taken in connection with the accompanying drawings.

FIGS. 1 to 4 show a first embodiment of this invention. The reference numeral 1 indicates a bag, which has a handle 1*a* attached to the top surface thereof. Attached to one of the side surfaces of this bag 1 is a lodging device 3 in which a shoulder strap 2 (which constitutes "the suspending strap" of this invention) is lodged. Provided on the side surface opposed to the one to which the lodging device is attached is a hook fixture (not shown), which is to be detachably engaged with an engaging member 2*a* attached to the external end of the shoulder strap 2. The above-mentioned lodging device 3 is composed of a withdrawing means 5 for withdrawing the shoulder strap 2 into the lodging device 3, a locking means 6 for preventing the shoulder strap 2 from being withdrawn or extracted inadvertently, and a releasing means 7 for releasing the shoulder strap 2 from locking by the locking means 6. The withdrawing means 5, the locking means 6, and the releasing means 7 are arranged inside a case cover 4. The reference numeral 41 indicates a guide opening, through which the shoulder strap 2 is extracted or withdrawn.

The reference numeral 51 indicates a winding shaft, which serves as the winder constituting the withdrawing means 5. This winding shaft 51, which extends in the direction perpendicular to the longitudinal direction of the suspending strap, is rotatably arranged across two brackets 52 which are integrally formed with a mounting surface section 52*a* to be attached to the bag 1. Both end sections of this winding shaft 51 protrude beyond the respective brackets 52. The winding shaft 51 is normally biased in the winding direction by means of a flat spiral spring 53, whose inner end is fitted into a slot 51*a* provided at one end of the winding shaft 51, and whose outer end is attached to the bracket 52 which is on the same side as the slot 51*a*. The reference numeral 54 indicates a winding drum, which is attached to the winding shaft 51 so as to be able to integrally rotate with it. Attached to this winding drum 54 is the inner end of the shoulder strap 2 which is to be wound around this drum.

The locking means 6, which controls the movements of the shoulder strap 2 in both the withdrawing and the extracting directions in a stepless manner, is fitted onto that end of the winding shaft 51 at which the slot 51*a* is provided. The locking means 6 is composed of a rotary body 61 which has a gear-like section and which is adapted to integrally rotate with the winding shaft 51, and a ratch body 62 adapted to detachably engage with the above-mentioned gear-like section. The ratch body 62 mentioned above is composed of a ring-like section 62*a*, in which the rotary body 61 is arranged with some play therebetween, a ratch-engagement section 62*b*, which protrudes from the inner periphery of the ring-like section 62*a* toward the rotary body 61 so as to be engaged with the gear-like section of the rotary body 61, and an arm 62*c* which protrudes outwards from that portion of the ring-like section 62*a* which is diametrically on the opposite side of the ratch-engagement section 62*b*. The arm 62*c* includes an elongated hole 62*d* which is engaged with a pin 63, which extends across the brackets 52 and protrudes therefrom, with some play therebetween. A compression spring 64 is provided between the pin 63 and the ratch body 62, so that the ratch-engagement section 62*b* is biased in such a manner that it is normally engaged with one of the rounded root areas of the gear-like section of the rotary body 61. The ratch body 62 is capable of sliding in the longitudinal direction while guided by guides 65 provided on the brackets 52.

Because the locking means is provided in the withdrawing means, the weight of the portable object or the impact load, which is caused, for example, when the portable object is lifted, is prevented from being directly exerted on the suspending strap, thereby enabling the suspending strap to be securely locked in position and allowing it to enjoy a long service life.

The reference numeral 71 indicates an operating button constituting the releasing means 7. The base end section of this button 71 is integrally attached to the outer end of the arm 62c of the ratch body 62, and the external end section thereof protrudes outwards through an opening 72 formed in the case cover 4. When this operating button 71 is depressed, the ratch body 62 slides inwards, causing disengagement of the ratch-engagement section 62b from the rotary body 61.

In this embodiment, that surface of the base end section of the operating button 71 which is attached to the arm 62c has a relatively large area so as to allow the ratch body 62 to slide easily in the longitudinal direction when the button 71 is depressed. In view of this, an additional arm 62c is provided on that side of the device which is opposite to the side where the ratch body 62 is provided. This additional arm is also biased by a compression spring 64, the two arms 62c being bridged together.

Figure 5:
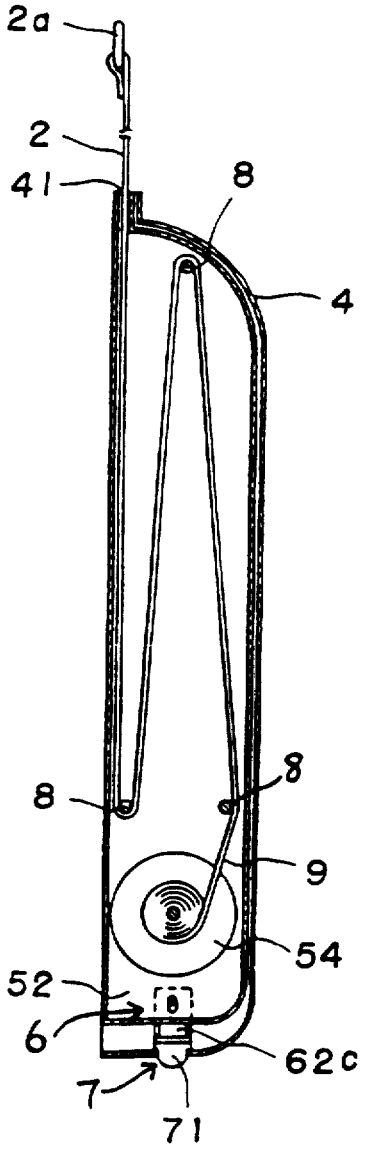
FIG. 5 is a sectional side view of a suspending strap lodging device in accordance with a second embodiment of this invention.
Figure 6:
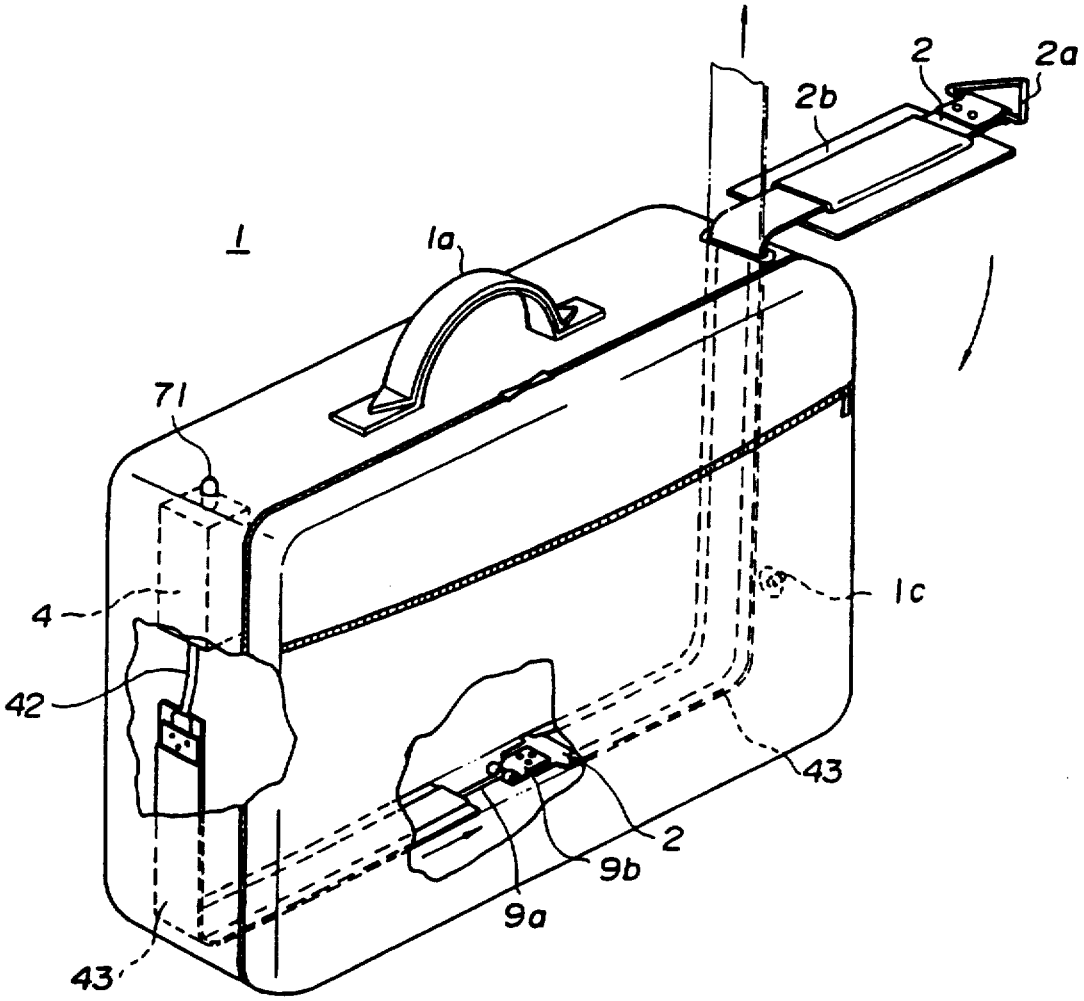
FIG. 6(*a*) is a perspective view showing the inner structure of a portable object which is provided with a suspending strap lodging device in accordance with a third embodiment of this invention.
Figure 6:
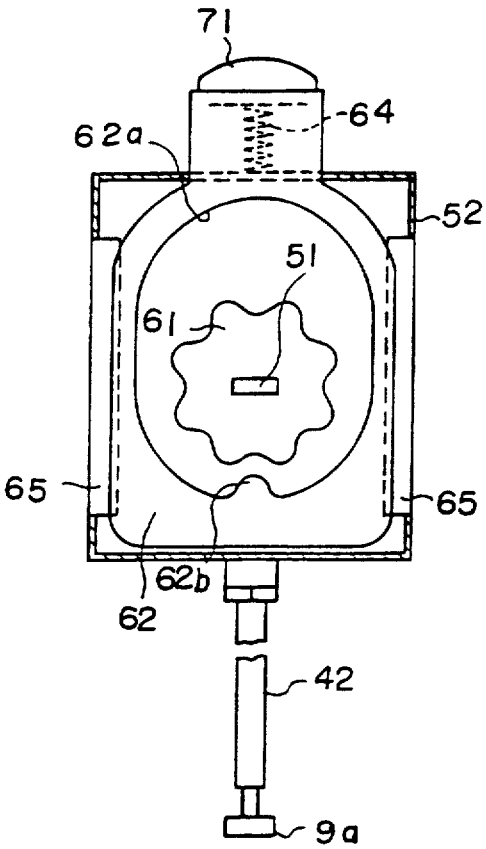
Figure 6:
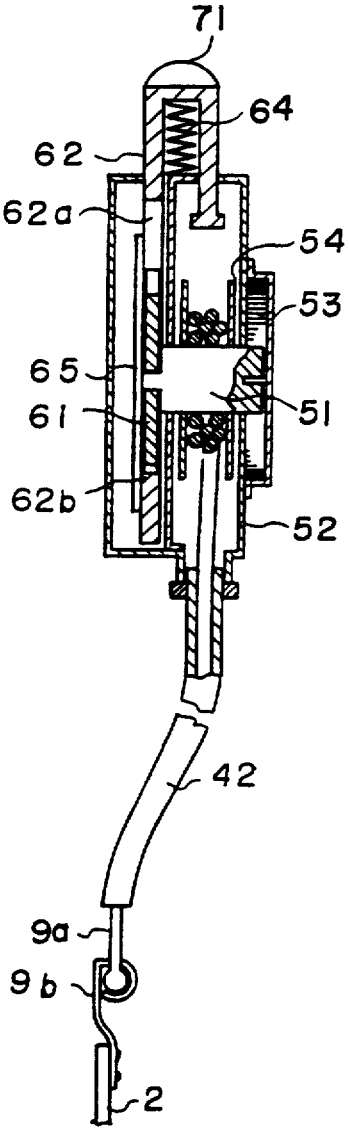
Figure 6:
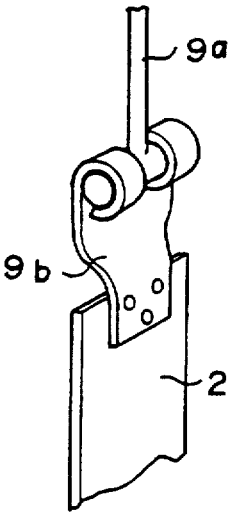

FIG. 5 shows a strap lodging device in accordance with a second embodiment of this invention. In this embodiment, the diameter of the winding drum 54 is prevented from becoming excessively large when the shoulder strap 2 is withdrawn into the lodging device. In accordance with this embodiment, that portion of the shoulder strap 2 which is never extracted from the lodging device 3 is formed as a very thin tape 9, whereas that portion which is extracted is formed as an ordinary strap. These two portions of the shoulder strap 2 are connected to each other. At the same time, a plurality of axles 8 are arranged in a zigzag-like manner within the lodging device 3, so that the suspending strap lies in a zigzag line in the lodging device before it is wound around the winding drum 54. Another feature of this embodiment which distinguishes it from the previous one is that the locking means 6 and the releasing means 7 are not situated in the front section of the device, as in the first embodiment, but in the rear section thereof.

FIGS. 6(a) to 6(d) show a strap lodging device in accordance with a third embodiment of this invention. In this embodiment, the shoulder strap 2 consists of a strap portion and a wire 9a, which are connected to each other by means of a joint member 9b. The base end section of the wire 9a is attached to the winding drum 54. The shoulder strap 2 of this embodiment is adapted to slide through a flexible tube 42 and a U-shaped guide 43 provided on the inner bottom surface and the two opposing inner side surfaces of the bag 1. In the lodged position, the shoulder strap 2 is in the guide 43. The shoulder strap 2 is equipped with a slidable shoulder pad 2b, which cannot be lodged in the guide 43 and remains outside. This shoulder pad 2b is bent over one of the side surfaces of the bag 1 and is securely positioned on this surface by means of snaps, buttons or other fasteners 1c which are provided on the bag 1 and the shoulder strap 2, respectively. The reference numeral 64 indicates a spring for causing the ratch-engagement section 62 to be normally engaged with the rotary body 61.

Figure 7A:
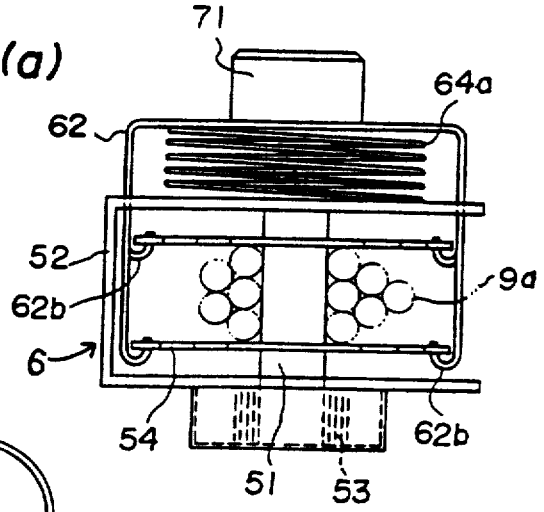
FIGS. 7(*a*), 7(*b*) and 8 are side views of locking and releasing mechanisms in accordance with fourth and fifth embodiments of this invention.
Figure 7:
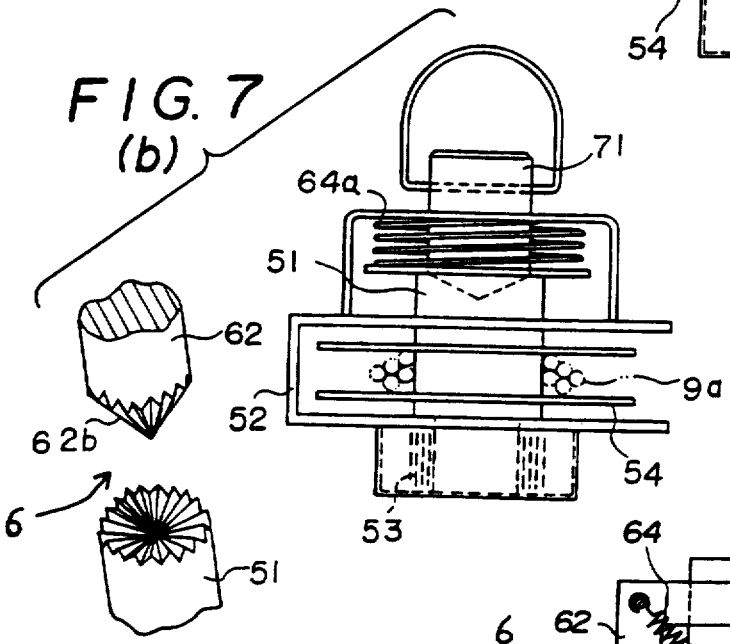

FIGS. 7(a) and 7(b) show locking means 6 in accordance with a fourth embodiment of this invention. In this embodiment, the rotary body 61 need not be provided. In the structure shown in FIG. 7(a), gear-like sections are formed on the outer periphery of the winding drum 54. The ratch body 62 is directly engaged with these gear-like sections, with a spring 64a provided therebetween. Disengagement is effected by depressing the operating button 71. Instead of the gear-like sections, recesses which are appropriately spaced from each other may be formed on the winding drum 54. In the structure shown in FIG. 7(b), a bevel-gear-like section is formed on one end surface of the winding shaft 51. This bevel-gear-like section is engaged with a bevel-gear-like section provided on the ratch body 62 which is integrally formed with the operating button 71. As in the structure shown in FIG. 7(a), the ratch body 62 in this structure is directly engaged with the winding shaft 51 by the force of the spring 64a, which is provided therebetween and which normally presses the bevel-gear-like section of the ratch body 62 against the corresponding bevel-gear-like section of the winding shaft 51. In this structure, disengagement can be effected by pulling the operating button 71. Thus, the operating button in this structure will be easier to handle if a pulling chord or the like is attached thereto.

Figure 8:
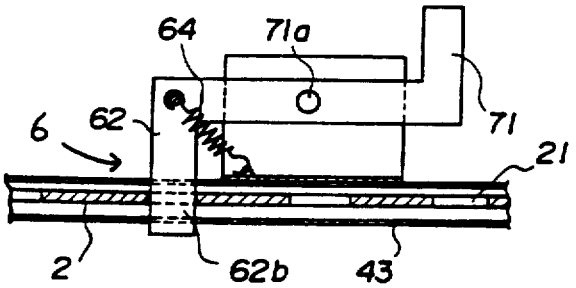
Figure 9:
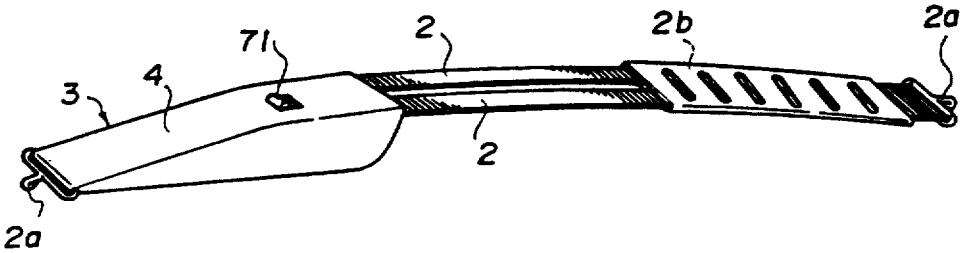
FIG. 9 is an overall perspective view of a suspending strap equipped with a strap lodging device in accordance with a sixth embodiment of this invention.

FIG. 8 shows a locking means 6 in accordance with a fifth embodiment of this invention. In this embodiment, the locking means is not provided in the withdrawing means 5. Instead, it exerts a locking action directly on the strap 2. The ratch body 62 of this embodiment is integrally formed with the operating button 71. In accordance with this embodiment, the strap 2 is provided with a plurality of engagement holes 21, and one end of the ratch body 62, supported by a fulcrum axle 71a, is fitted into one of these engagement holes 21 by the force of the spring 64. This locking means 6 can be provided at a desired position (e.g., the external-end section) of the suspending strap guide 43.

FIGS. 9 to 14 show a sixth embodiment of this invention. The reference numeral 1 indicates a bag 1, which constitutes an example of the portable object to which this embodiment is to be applied. This bag 1 has a handle 1a on its top surface and link members 1b on the respective small side surfaces thereof. The link members 1b are adapted to be detachably engaged with engaging members 2a attached to the respective free ends of the shoulder strap 2, 2, which is separated in the longitudinal direction to form two elongated parallel strap portions.

The reference numeral 3 indicates a lodging device attached to the strap 2. This lodging device 3 consists of a withdrawing means 5 for winding up the shoulder strap 2, a locking means 6 for controlling the movements in the winding and the extracting directions of the shoulder strap 2, and a releasing means 7 for releasing the locking effected by the locking means 6. These three means are arranged within a case cover 4. The reference numeral 41 indicates diverging guide openings for guiding the shoulder strap 2,2 when it is extracted or withdrawn.

The reference numeral 51 indicates a winding shaft, which constitutes the withdrawing means 5. This winding shaft 51 extends across the brackets 52 integrally formed with the case cover 4. The winding shaft 51 is normally biased in the winding direction by means of a low-load spring 53, whose inner end is fitted into a slot 51a provided at one end of the winding shaft 51 and whose outer end is attached to the bracket 52 on the same side as the slot 51a. The reference numeral 54 indicates a winding drum which is integrally formed with the winding shaft 51. One end of the shoulder strap 2, 2 is attached to this winding drum 54, which is adapted to wind up the shoulder strap 2, 2. When wound up, the two longitudinally extending portions of the shoulder strap 2, 2 lie close to each other.

The reference numeral 61 indicates a rotary body, which constitutes the above-mentioned locking means 6. The rotary body 61 is integrally formed on the outer periphery of the winding drum 54 provided on the winding shaft 51, and has a gear-like configuration with projections and recesses. The ratch body 62 is integrally formed with the operating button 71 constituting the releasing means 7 so as to form a substantially V-shaped member. This V-shaped member is supported by a fulcrum axle 71*a* attached to the bracket 52, and is biased by a press spring 64*a* in such a manner that the ratch section 62 is normally engaged with one of the recesses of the rotary body 61 formed on the winding drum 54, thereby controlling the rotation of the winding drum 54. Further, the operating button 71 slightly protrudes beyond the case cover 4. By sliding this button 71, disengagement of the ratch section 62 from the rotary body 61 can be effected.

Figure 10:
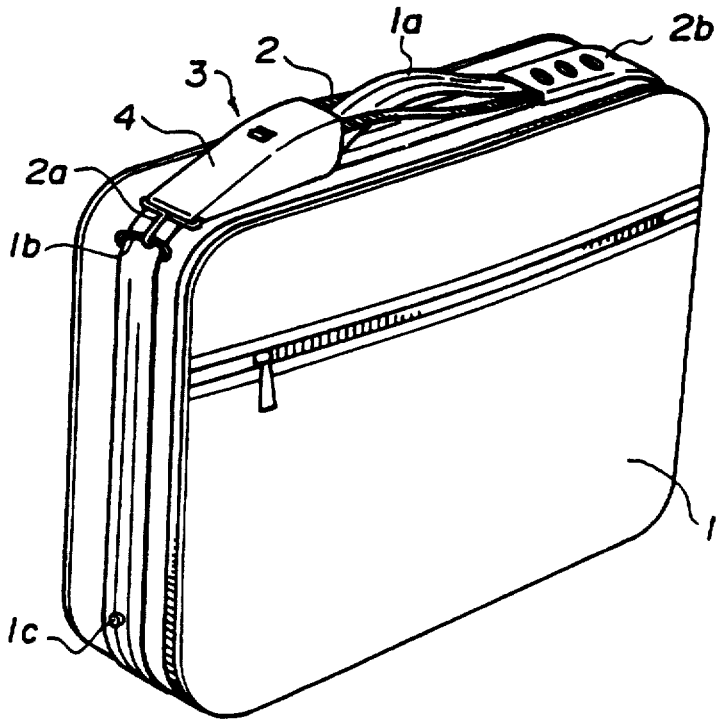
FIGS. 10(*a*) and 10(*b*) are overall perspective views of a bag with a strap equipped with the strap lodging device of FIG. 9.
Figure 10:
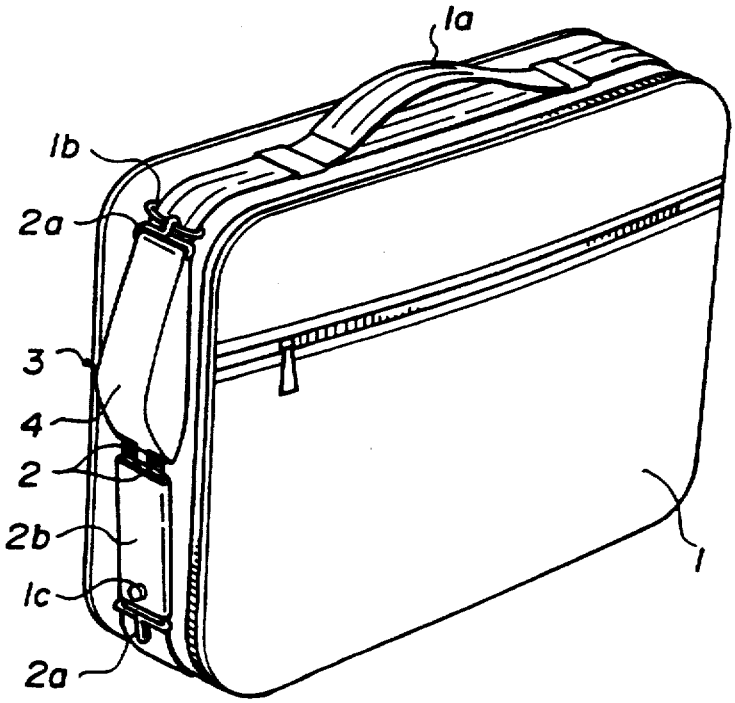
Figure 11:
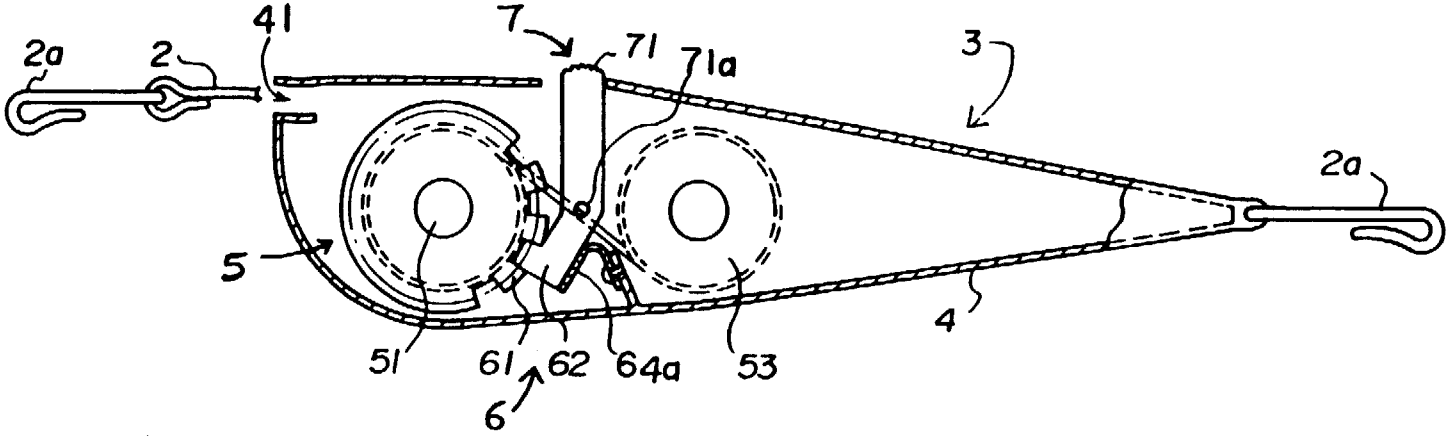
FIG. 11 is an inner side view of the strap lodging device of FIG. 9, showing the locking and releasing mechanisms.
Figure 12:
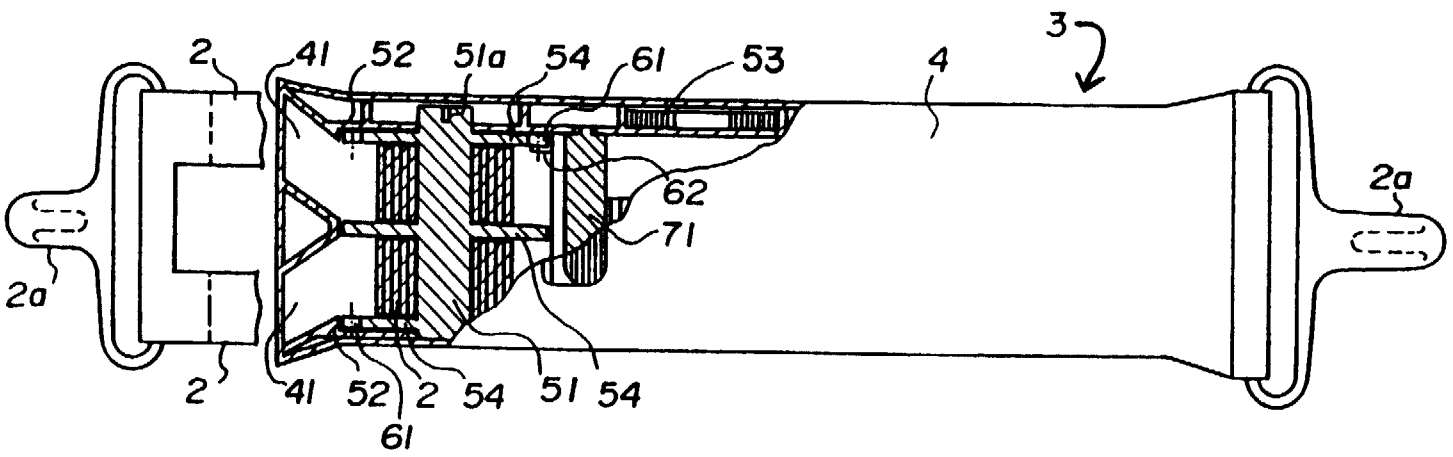
FIG. 12 is a horizontal sectional view of the mechanisms of FIG. 11.
Figure 13:
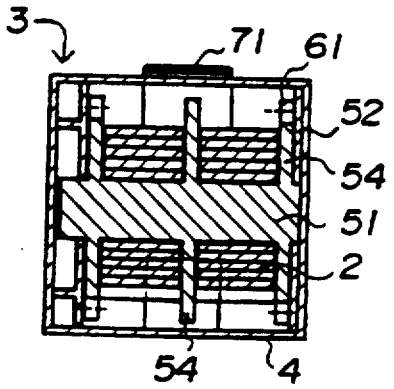
FIG. 13 is a front sectional view of the mechanisms of FIG. 11.
Figure 14:
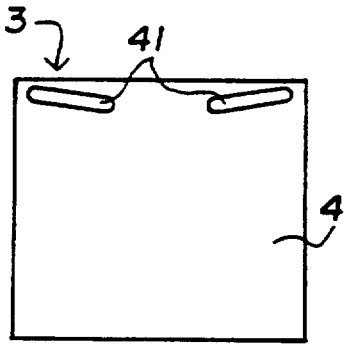
FIG. 14 is a front elevational view of the case cover for the mechanisms of FIG. 11.

In the condition shown in FIG. 10(*a*), the longitudinally separated strap 2, 2 is guided by through-guides provided in the shoulder pad 2*b*, the distance between the two portions of the strap being maintained such that the handle 1*a* can be used. In the condition shown in FIG. 10(*b*), the lodging device 3 is turned upside down and moved onto one of the side surfaces of the bag 1, the shoulder pad 2*b* being securely positioned on this side surface by means of a snap, button or other fastener 1*c* provided thereon.

This embodiment can be applied not only to a separation-type strap 2,2, but also to an ordinary unitary strap or a chord-like strap. Various materials may be used for the entire lodging device or a part thereof. Further, it is also possible to provide a plurality of lodging devices 3 depending upon the winding diameter. Also, various position(s) of the lodging device(s) may be selected.

This suspending strap can be used on existing portable objects such as a bag, a camera, etc. which have already been purchased and are being used, or on portable objects which offer little space for mounting a suspending strap lodging device. This suspending strap, which is equipped with a lodging device of its own, can easily replace the shoulder straps of existing portable objects. Moreover, it does not diminish the effective space of the associated portable object, and can be attached to a portable object in which little space is available for mounting a suspending strap lodging device. Further, this suspending strap can also be used as a seat belt in a vehicle or the like, or a safety belt for operations at an elevated spot, etc. Thus, this suspending strap equipped with a suspending strap lodging device should have a wide range of use.

Figure 15:
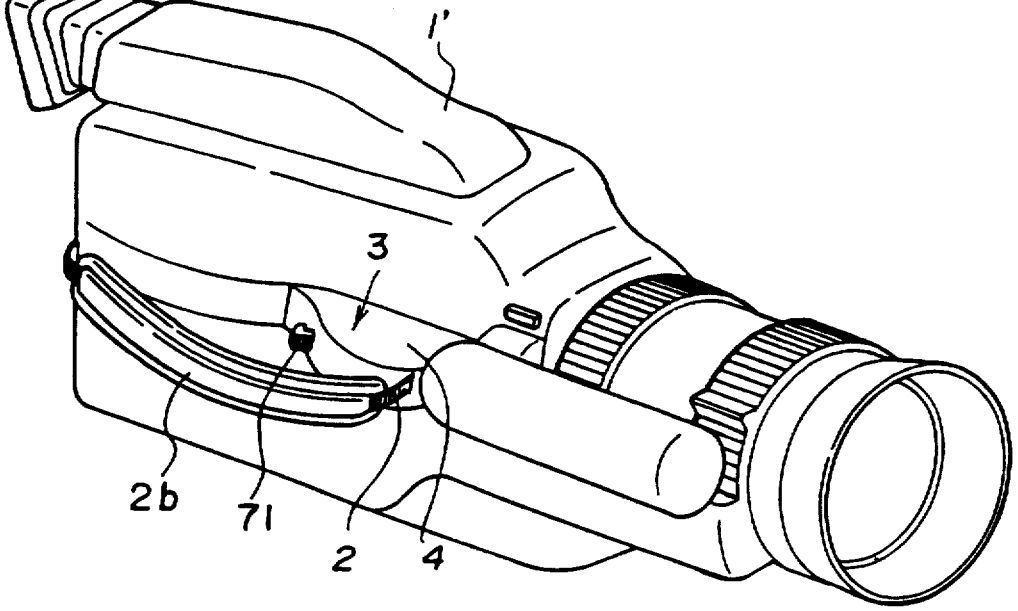
FIG. 15(*a*) is an overall perspective view of a video camera which is equipped with a strap lodging device in accordance with a seventh embodiment of the invention, showing the strap lodged in the lodging device.
Figure 15:
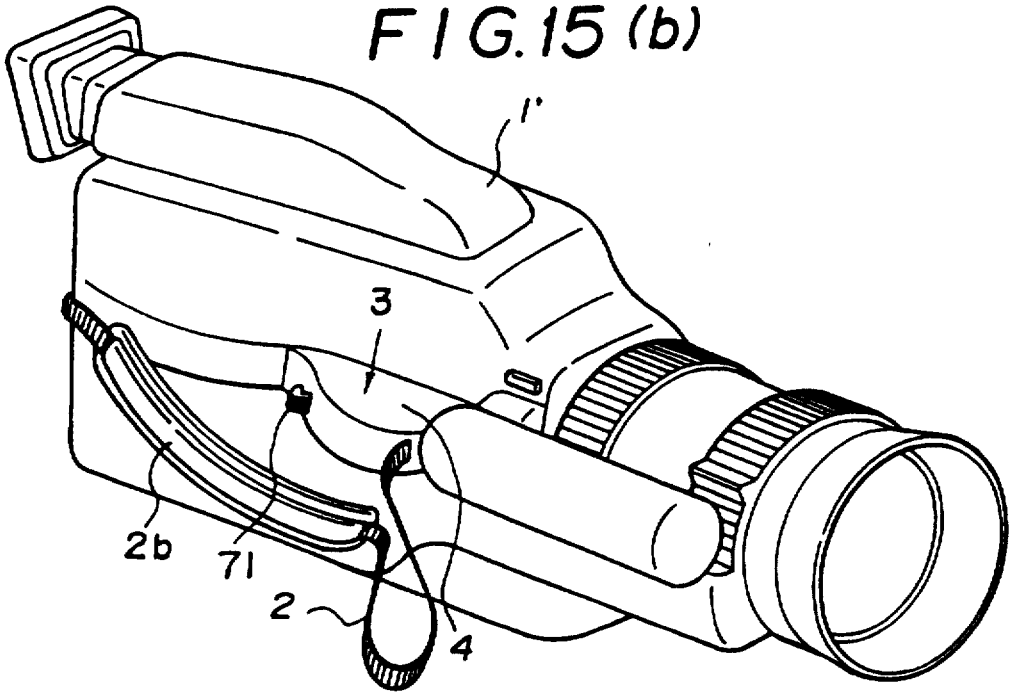

FIGS. 15(*a*) and 15(*b*) show a seventh embodiment of this invention. The reference numeral 1' indicates the body of a video camera, which constitutes an example of the portable object to which this embodiment is to be applied. Provided on one of the side surfaces of the video camera body 1' is a grip strap 2 and a hand pad 2*b* for enabling the video camera body 1' to be firmly supported by hand. The reference numeral 3 indicates a strap lodging device provided at one end of the grip strap 2. This lodging device 3 is composed of a withdrawing means 5 for winding up the strap 2 to lodge it in the lodging device, a locking means 6 for steplessly controlling the movements in the winding and the extracting directions of the strap 2, and a releasing means 7 which allows the locking effected by the locking means 6 to be canceled through proper manipulation of the operating button 71. These three means are arranged within a case cover 4, allowing the strap 2 to be extracted or wound up.

The pad 2*b*, provided on the strap 2, is equipped with a through-guide, through which the strap 2 is guided, thus enabling the pad 2*b* to be displaced along the strap 2. In the condition shown in FIG. 15(*a*), in which the strap 2 is lodged in the lodging device, the strap 2 and the pad 2*b* can be used as the grip strap and the handle, respectively. In the condition shown in FIG. 15(*b*), in which the strap 2 has been extracted, the strap 2 and the pad 2*b* can be used as the shoulder strap and the shoulder pad, respectively.

The strap of a video camera, for example, has to serve as a shoulder strap, a handle, a hand grip, etc. A video camera has to be equipped with a hand strap, which should be adjusted to the size of the user's hand so as to enable him or her to photograph in a stable condition, a hand grip and a shoulder strap. Conventionally, these three components have been arranged at three different positions of the camera. In contrast, in accordance with this embodiment, they are all situated at a single position of the camera, the shoulder strap being endowed with all of these functions, thereby making the video camera more convenient to use, facilitating the stock control for video cameras, and obviating the inefficient use of the mounting space.

Figure 16:
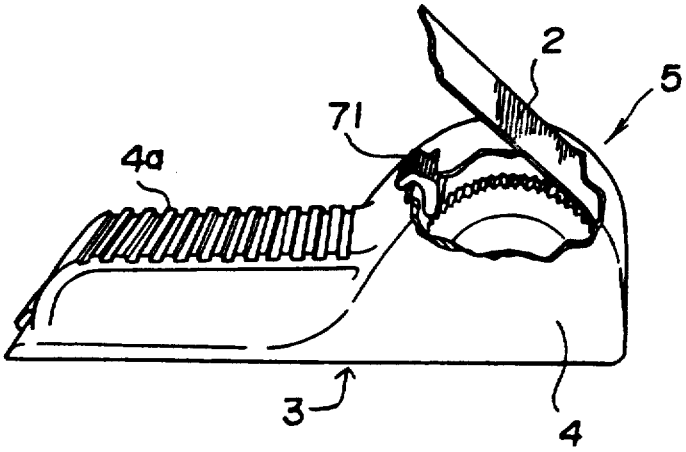
FIG. 16(*a*) is an overall perspective view, partly broken away, of a strap lodging device in accordance with an eighth embodiment of the invention.
Figure 16:
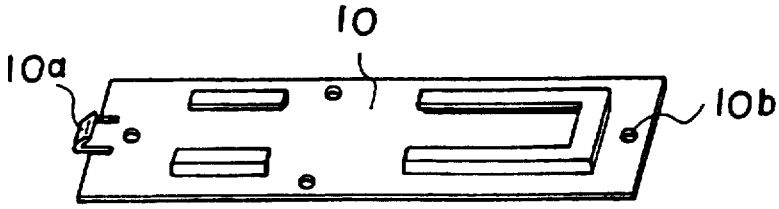

FIGS. 16(*a*), 16(*b*), 17(*a*) and 17(*b*) show an eighth embodiment of this invention. The reference numeral 4 indicates a case cover 4 in which the above-mentioned strap lodging device 3 is arranged. As in the above embodiments, the strap 2 can be extracted or wound up by manipulating the operating button 71. The strap lodging device 3 is situated in the front section of the case cover 4, and a hand grip 4*a* is integrally formed in the rear section of the case cover.

Figure 17A:
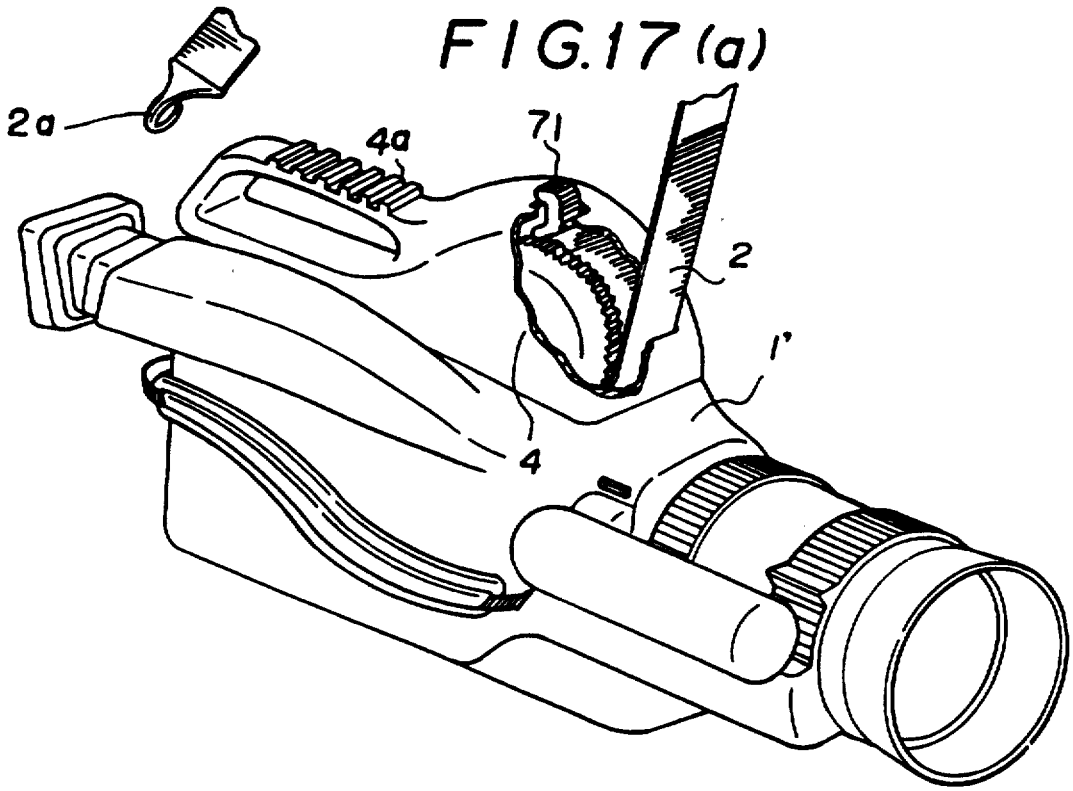
FIGS. 17(*a*) and 17(*b*) are perspective views of a video camera and a bag, respectively, to which the strap lodging device of FIGS. 16(*a*) and 16(*b*) is attached.
Figure 17B:
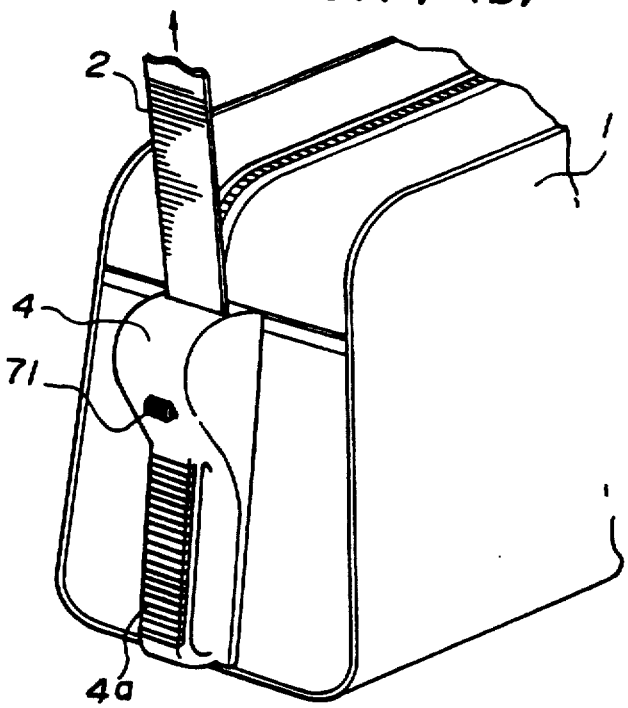

The reference numeral 10 indicates a mounting plate for attaching the strap lodging device 3 or the case cover 4 to a portable object. As shown in FIGS. 17(*a*) and 17(*b*), this mounting plate 10 can be attached to the video camera 1' or the bag 1 at any position thereof. Provided on this mounting plate 10 is a recessed section corresponding to a protruding section (not shown) provided on the bottom surface of the strap lodging device 3 or the case cover 4. Thanks to these protruding and recessed sections, the strap lodging device 3 or the case cover 4 can be attached to the associated portable object in a sliding manner. The lodging device or the case cover can be locked, so that it may not be detached from the portable object, by means of a slide lip 10*a* which protrudes upwardly in a biased state. The lodging device can be unlocked by depressing this slide lip 10*a* downwards. The reference numeral 10*b* indicates attachment holes for attaching the mounting plate to a portable object.

Next, the respective operations of the first to the eighth embodiments of this invention, which are constructed as described above, will be described.

First, the operation of the first embodiment will be described. The shoulder strap 2 is normally used when the associated portable object is large or heavy, when it is to be carried about for a long time, or when the person carrying it wishes to use both hands for other purposes. In the case of the bag 1, for example, the shoulder strap 2 is attached thereto together with the handle 1*a*, one or the other being used depending upon the way in which the bag 1 is used. When the handle la is used, i.e., when the shoulder strap 2 is not needed, a conventional strap will hang down from the bag 1, so that it may be caught by some protruding object when the bag is being carried and thereby cause the bag to drop, or it may even cause an accident if it is caught by a vehicle or the like. In addition, such a conventional strap may become dirty when the bag 1 is placed on the ground or the like, causing the clothes of the person carrying the bag to be stained.

In this regard, the shoulder strap 2 of this invention can be withdrawn into the lodging device 3 by means of the withdrawing means 5, the shoulder strap 2 being wound around the winding drum 54 of the withdrawing means 5, which winding drum is normally biased in the winding direction by means of the flat spiral spring 53. Thus, the shoulder strap 2 can be extracted or withdrawn depending upon whether or not it is needed. When it is not needed, the shoulder strap can be securely lodged in the lodging device 3, so that it does not hang down from the associated portable object as with conventional straps. Thus, there is no danger of it being caught by some protruding object, causing the portable object to drop or, in extreme cases, causing a fatal accident. Furthermore, since it is lodged in the lodging device, the suspending strap will not become dirty if the portable object is placed on the ground or the like, which means it is securely prevented from staining the clothes of the person carrying the portable object.

Further, even if both ends of the shoulder strap 2 are fixed to the bag 1, the strap 2 can be maintained in close contact with the outer peripheral surface of the bag 1 by means of the withdrawing means 5, so that the strap will not hang down, which means the above advantage can also be obtained in such a case. Further, when the lodging device 3 is so designed that it can be movably mounted on the bag 1, it can be positioned not only on the top surface of the bag but also on one of the side surfaces or the bottom surface thereof. In that case, the strap 2 can be held around the outer periphery of the bag 1 in close contact therewith. Accordingly, that portion of the strap 2 which is wound around the winding drum is relatively small, which means the lodging device 3 can be made still more compact.

Next, the operation of the second embodiment will be described. This embodiment aims to cope with the problem that, if the shoulder strap 2 is required to be relatively thick, the winding diameter becomes inevitably large when the strap is wound around the winding drum 54 so as to be lodged in the lodging device, with the result that the size of the lodging device 3 has to be rather large. In accordance with this embodiment, the suspending strap is composed of a shoulder strap portion and a very thin tape 9 which is connected to it. Further, the lodging device includes a zigzag lodging section in which the shoulder strap 2 lies in a zigzag line. When the shoulder strap 2 is lodged, it is only the thin tape 9 that is wound around the winding drum 54, the shoulder strap portion remaining in the above-mentioned zigzag lodging section. Thus, this embodiment is advantageous in that the winding diameter of the winding drum 54 can be made smaller. Furthermore, the size of the winding drum 54 itself can also be made relatively small, with the result that the entire lodging device 3 can have a compact structure.

The operation of the third embodiment will now be described. Like the second embodiment, the third embodiment of this invention aims to cope with the problem that, if the shoulder strap 2 is required to have a certain level of thickness, the winding diameter becomes inevitably large, resulting in the lodging device 3 itself becoming rather large. This embodiment distinguishes itself from the foregoing one in that it adopts a wire 9a instead of the thin tape 9. Thus, the suspending strap 2 of this embodiment is composed of a shoulder strap portion and the above-mentioned wire 9a which is connected to it. The length of the wire 9a corresponds to that of the U-shaped strap guide 43 provided around the periphery of the bag 1. When the suspending strap 2 is lodged, only the wire 9a is wound around the winding drum 54, so that the winding diameter of the winding drum 54 does not depend on the thickness of the shoulder strap 2 at all. As a result, the lodging device 3 can be made very light and compact. If the shoulder pad 2b of the strap 2 is so designed that it can be turned upside down and held on one of the side surfaces of the bag 1, the entire lodging device 3 can be made thinner and smaller. The lodging device can then also be applied to a relatively small portable object.

Further, the above-mentioned guide 43 of this embodiment can also be applied to a case where the extra portion of the strap 2 which hangs down from the bag, as in the first embodiment, is allowed to be exposed and lie along the periphery of the bag 1. In that case, it is naturally possible to so design the lodging device that the shoulder strap 2 itself is directly wound around the winding drum instead of the tape 9 or the wire 9a.

Next, the operation of the fourth embodiment will be described. This embodiment consists of a modification of the locking means 6 of this invention. In accordance with this invention, the rotary body 61 is not needed. In the example shown in FIG. 7(a), gear-like sections are formed around the outer periphery of the winding drum 54. By means of these gear-like sections, the winding drum 54 can be directly engaged with the ratch body 62 under bias of spring 64a. By thus effectively utilizing the outer periphery of the winding drum 54, the overall structure of the locking means 6 is simplified, requiring less parts. Accordingly, the entire lodging device 3 can be made thinner and smaller. In the case of the example shown in FIG. 7(b), a bevel-gear-like section is formed at one end of the winding shaft 51. This bevel-gear-like section is adapted to be engaged with the corresponding bevel-gear-like section of the ratch body 62, which is integrally formed with the operating button 71. In this way, the winding shaft 51 is utilized effectively. Moreover, the winding shaft 51 can be disengaged from the ratch body 62 in a smooth manner by pulling the operating button 71. Thus, the overall structure of the locking means 6 can be simplified, requiring less parts. Accordingly, the entire lodging device 3 can be made thinner and smaller.

The operation of the fifth embodiment will now be described. Unlike the above fourth embodiment, in which the locking means 6 is in the form of an engagement structure formed in the withdrawing means 5, this embodiment adopts a so-called buckle-type structure in which the strap 2 is directly locked. By adopting this type of locking means 6, the lodging device can be provided at a desired position (e.g., at the front end) of the suspending-strap guide 43. By forming the tape 9 of the second embodiment of a hard material such as steel, and equipping it with a lodging mechanism, it becomes unnecessary for a lodging mechanism to be directly provided on the shoulder strap 2, with the result that the strap 2 is protected from damage.

Next, the operation of the sixth embodiment will be described. This embodiment distinguishes itself from the foregoing ones in that the strap lodging device 3 is not associated with a particular portable object. Instead, the lodging device 3 and the shoulder strap 2 constitute a totally separate product which can be detachably attached to existing portable objects.

To attach this shoulder strap 2, which is equipped with the lodging device 3, to a bag 1, the engaging member 2*a* provided at one end of the lodging device 3 is engaged with a link member 1*b* provided on the bag 1. The shoulder strap 2 is extracted a desired length by releasing locking means 6 by manipulating the operating button 71, and engaging the engaging member 2*a* provided at the free end of the strap 2 with the corresponding link member 1*b* of the bag 1.

When the strap itself is thus equipped with a lodging device 3, the bag 1 can be manufactured by the usual manufacturing processes, attaching the link members 1*b* to it afterwards. Further, it should be noted that most of the bags currently on the market are equipped with straps which are detachably attached to the bags by means of engaging members, which means the straps of these existing bags can be easily replaced by the shoulder strap of this embodiment. Moreover, the shoulder strap of this embodiment can be applied not only to a bag but also to a video camera, a thermos flask, a radio, a guitar, etc., which means a single strap equipped with a lodging device can be used for various types of portable objects. Further, one of the engaging members 2*a* is not attached to the strap 2 but directly to the case cover 4 of the lodging device 3, so that if this engaging member 2*a* is detached from the associated link member 1*b*, the case cover 4 can serve as a pulling grip when the portable object is a castered suit case.

Further, by reinforcing its components, the lodging device and the associated strap can be used as a safety belt for protecting the body of a worker operating at an elevated spot, e.g., high up on a utility pole. Apart from this, they can be applied to various types of securing straps such as a seat belt in a vehicle or the like, or a luggage strap for a roof carrier or the like. Thus, this embodiment will find a wide range of use.

What is particularly to be noted regarding this embodiment is the fact that the strap 2, 2 is longitudinally separated, i.e., it consists of two parallel portions extending in the longitudinal direction. These two portions are guided through a through-guide provided in the shoulder pad 2*b*. There is an appropriate space between these parallel portions, so that the handle 1*a* can be used. In the condition shown in FIG. 10(*a*), the shoulder strap 2 is exposed but does not constitute an obstacle when the handle la is used. Thus, even if the shoulder strap 2 becomes unnecessary and is replaced by the handle 1*a* while the portable object is being carried, the strap will not be in the way. Further, if the strap guides 41, 41 are outwardly divergent (see FIG. 14), the distance between the two portions of the strap 2, 2 can be made as small as possible when the strap is withdrawn therethrough, so that, even if the distance between the two strap portions when the strap is in use is relatively large, it does not lead to an increase in the width of the lodging device 3. Further, in the position shown in FIG. 10(*b*), the shoulder pad 2*b* is engaged with a snap, button or other fastener 1*c* provided on one of the side surfaces of the bag 1, so that the lodging device 3 is not in the way.

Next, the operation of the seventh embodiment will be described. This embodiment suggests an improvement that can be attained when the strap lodging device 3 of this invention is applied to a video camera 1′ or the like. In a relatively small video camera, the handle on the top surface of the camera is omitted; the function of this handle is provided by the hand grip arranged on one side surface of the camera body. An adjusting member such as a so-called buckle or a face fastener allows a fine adjustment of the shoulder strap and the hand grip strap, both being used at different positions as indispensable components.

In accordance with this invention, the strap lodging device 3, which allows the strap 2 to be extracted or wound up, is attached to the video camera body 1′ at the position where the grip strap or the hand grip is provided. When using the video camera, the strap 2, which has been lodged in the lodging device 3 as shown in FIG. 15(*a*), is extracted and adjusted to the size of the user's hand by fine adjustment, enabling the camera to be firmly supported by hand. Thus, the shoulder strap 2 can also be used as the grip strap or the hand grip, and the shoulder pad 2*b* can also be used as the hand pad or the handle. When the camera is to be carried after the photographing, the strap 2 is extracted while depressing the operating button 71, bringing it to the extracted position shown in FIG. 15(*b*). In this condition, the strap 2 is used as the shoulder strap, and the pad 2*b* can be slid to a desired position where it is used as the shoulder pad.

Thus, the strap 2, which is normally used as the grip strap or the hand grip when in its lodged position, as in a conventional camera, can also be used as the shoulder strap when the camera 1 is carried about. In this way, the strap of this invention, which requires only one mounting position on the camera, provides the functions of the shoulder strap, the hand grip and the grip strap, thus enabling the mounting space to be used effectively and facilitating the stock control of such cameras.

Although this embodiment has been described as applied to a small video camera 1′, this should not be construed as restrictive. It can be applied to various types of portable objects including a camera, a bag, an attache case, etc. For instance, a handle may be provided on a desired surface of the outer periphery of a portable object, and a strap lodging device 3 may be provided at one end thereof.

Next, the operation of the eighth embodiment, which is applied to a relatively large video camera of an ordinary type, will be described. Such a large video camera is equipped with a hand grip provided on the top surface thereof, a shoulder strap attached to a mounting section provided on the bottom surface thereof, and a hand grip strap provided on a side surface thereof. As shown in FIGS. 16 and 17, the strap lodging device 3 of this embodiment is composed of a strap withdrawing means 5 in which the lodging mechanism is arranged, a case body 4 in which the withdrawing means 5 is arranged, and a hand grip 4*a* formed on the case body 4. The strap lodging device 3 has a protruding section, which is slid into a recessed section of a mounting plate 10 provided on an outer surface of a portable object such as a video camera, thus engaging the strap lodging device 3 with the mounting plate 10. Disengagement can be effected by manipulating a slide slip 10*a* formed on the mounting plate 10. This mounting structure, which is well known, allows the lodging device 3 to be easily attached to or detached from the video camera 1′ while using the hand grip 4*a* as a handle. When the strap lodging device 3 is attached to the video camera 1′ or the bag 1, the hand grip 4*a* can replace the conventional hand grip. Thus, if used together with the mounting plate, one strap lodging device can be attached to various portable objects irrespective of the types of these objects. This arrangement is not only very economical, but helps to facilitate the stock control of the relevant portable objects and obviate the inefficient use of the mounting space since the three components, the shoulder strap, the hand grip, and the grip strap, are united into one component, which only requires one mounting position.

Although the mounting plate of this embodiment is provided as a separate member, it can also be integrally formed with the camera body 1'. Further, it goes without saying that the strap lodging device 3 can be applied to a variety of portable objects, including a thermos flask, a radio, etc.

With the structures of this invention described above, the forces which are applied to the suspending strap in both the withdrawing and the extracting directions can be controlled steplessly and simultaneously. Thus, the suspending strap can be adjusted quickly at any time by extracting it a desired length in accordance with the figure of the person using the bag, etc., so that, unlike conventional suspending straps, it does not need any buckles or loops. Furthermore, it does not require the bothersome operation required of conventional straps of adjusting the length of the strap, and can be adjusted to the way the associated bag or the like is used. When, for example, the person using the bag, etc. wishes to carry it under his or her arm, the suspending strap can be withdrawn so that it will not be in the way. Thus, it can be adjusted within a wide range of adjustment. In addition, when the suspending strap becomes necessary or unnecessary while the associated portable object is being carried, the strap can be adjusted quickly to the new mode of use. Thus, when the strap becomes unnecessary, it can be securely withdrawn and lodged, so that, unlike conventional suspending straps, it will not hang down from the portable object. Accordingly, there is no danger of it being caught by some protruding object while the portable object is being carried, causing it to drop, or, in extreme cases, leading to a fatal accident. Further, the suspending strap is prevented from becoming dirty when the associated portable object is placed on the ground or the like, so that it does not stain the clothes of the person carrying the portable object. Furthermore, the suspending strap, which does not have to be detached from the associated portable object each time it becomes unnecessary, is not in the way when it is not being used. Thus, the present invention provides a totally novel strap lodging device which is remarkably convenient to use.

What is claimed is:

1. A carrying system, comprising:

a portable object;

a shoulder strap attachment and a lodging device for carrying the portable object by suspending the shoulder strap from a wearer's shoulder while attached to the portable object, the portable object having a handle at the center of a top surface thereof, wherein said shoulder strap attachment further comprises:

a case cover, in which said shoulder strap is lodged, attached to a side surface of the portable object;

an engaging member attached to the external end of said shoulder strap; and a fastening means for detachably engaging said engaging member, said fastening means being attached to a side surface of the portable object opposite to the side surface containing said case cover; and said lodging device comprises:

said case cover;

means for extracting and retracting said shoulder strap, so as to enable a portion of said shoulder strap to be lodged in said case cover, said means includes a winding shaft which rotates in a manner such that said shoulder strap is extracted and retracted in a direction perpendicular to a longitudinal direction of said shoulder strap rotatably arranged across two brackets which are integrally formed with a mounting surface section of said case cover, and a winding drum integrally and rotatably attached to said winding shaft and fixing one end of said shoulder strap;

a guide opening formed in said case cover for extracting and retracting the shoulder strap;

means for holding said winding shaft constantly biased in the winding direction, comprising a flat spiral spring; and locking means for preventing said winding shaft from rotating, said locking means comprising a rotary body which has a toothed portion and integrally rotates in both extracting and retracting directions together with the winding shaft in a stepless manner, said toothed portion is formed along a periphery of said rotary body with complimentary U-shaped recesses in both the extracting and retracting directions, said locking means is adapted to integrally rotates with said winding shaft, and a ratch body comprising an annular section in which said rotary body is loosely arranged therebetween and a ratch-engagement section which protrudes from an inner periphery of said annular section toward said rotary body so as to engage with said toothed section, said ratch body being capable of moving from a position where said toothed portion is engaged to prevent said winding shaft from rotating in both the extracting and retracting directions to a position where said toothed portion is disengaged thereby releasing said winding shaft to rotate in both the extracting and retracting directions, a press spring biasing said ratch body to engage said toothed portion, said press spring arranged between a pin and said ratch body such that said ratch-engagement section is biased to engage with a one of the U-shaped recesses of said toothed section, guides are arranged on right and left sides of said annular section for guiding said ratch body slidably in a longitudinal direction, and an operating member for moving said ratch body to said disengaged position where said ratch body and said toothed portion disengage, having overcome said press spring biasing, said operating member adapted such that extraction and retraction of said shoulder strap is possibly only when said ratch body is moved to said disengaged position.

2. A system as claimed in claim 1, wherein said fastening means comprises a hook.

3. A system as claimed in claim 1, wherein said operating member comprises:

a button, a base end portion of said button being integrally attached to a first end of an arm of said ratch body, with an external end portion of said button protruding outwardly through an opening in said case over, such that by depressing said button external end portion, said ratch body slides in the direction of button depression causing disengagement of a ratch-engagement portion from said toothed portion within said ratch assembly, thereby allowing said shoulder strap to be extracted or retracted, wherein releasing said button external end locks said locking means.

4. A system as claimed in claim 1, wherein said portable object is from a group comprising at least a suitcase, a brief case, an overnight bag, a purse, a cosmetic case, a camera case and all such similarly portable bags.

* * * * *